US005397521A

United States Patent [19]

Quinn

[11] Patent Number: 5,397,521

[45] Date of Patent: Mar. 14, 1995

[54] METHOD FOR FABRICATING A DIMENSIONALIZED CONFIGURATION

[76] Inventor: Pam Quinn, 3081 Quinn Rd., Kodak, Tenn. 37764

[21] Appl. No.: 907,300

[22] Filed: Jul. 1, 1992

[51] Int. Cl.[6] ..... B05D 3/00

[52] U.S. Cl. ..... 264/129; 427/271

[58] Field of Search ..... 427/265, 270, 271, 272, 427/275, 276, 277; 264/129

[56] References Cited

U.S. PATENT DOCUMENTS

| | | | |
|---|---|---|---|
| 278,958 | 6/1883 | Henay | 425/87 |
| 3,046,178 | 7/1962 | Tupper | 156/167 |
| 3,332,055 | 7/1967 | Bogner | 439/88 |
| 3,763,624 | 10/1973 | Bergland | 53/471 |
| 3,790,331 | 2/1974 | Backer | 425/464 |
| 3,892,690 | 7/1975 | Setterstrom | 264/53 |
| 3,975,223 | 8/1976 | Turoff | 427/276 |
| 4,496,510 | 1/1985 | Hanson et al. | 425/87 |
| 4,578,131 | 3/1986 | Hawkins, Jr. | 427/270 |
| 4,629,648 | 12/1986 | Minick et al. | 425/189 |
| 4,677,001 | 6/1987 | Wade et al. | 427/270 |

*Primary Examiner*—Jay H. Woo

*Assistant Examiner*—Robert B. Davis

*Attorney, Agent, or Firm*—M. Alex Brown

[57] ABSTRACT

A method employing a new use for acrylic latex caulk materials in fabricating durable dimensionalized configurations and background surfaces under room temperature conditions, for transfer to artistic and craft-oriented, artistic exhibition surfaces, is disclosed. The method is facilitated by a multilayered work surface specifically adopted for use in practicing the method. The method of the disclosed invention provides a mathematical relationship between the water fluid and the caulk material utilized in the method. This relationship is utilized to introduce these two components to create a slurry and to set up a precuring stage where the caulk material remains malleable for long periods of time. This provides the opportunity to more completely shape and form the treated caulk material to a desired, dimensionalized configuration. The configuration fabricated by the method, and substantial use of the special work surface, later becomes hardened, durable over long periods of time and capable of being attached to other services for exhibition purposes.

27 Claims, 10 Drawing Sheets

METHOD FOR FABRICATING A DIMENSIONALIZED CONFIGURATION

BACKGROUND OF THE INVENTION

1. Field of the Invention

This invention relates to a method and new use of caulk material in the arts and crafts field, for building a durable dimensionalized ornamental form or figure on a special work surface for transfer and positioning on an artistic exhibition surface.

2. Background Information

The applicant is aware of U.S. Pat. Nos. 4,629,648; 4,496,510; 3,892,690; 3,790,331; 3,763,624; 3,332,055; 3,046,178; and 278,958; issued respectively, to Minick et al., Hanson et al., Setterstrom, Backer, Bergland eta al., Bogner, Tupper and Henay.

The Minick '648 patent reference discloses a preformed caulk strip having fixed dimensions and an extruded caulking strip for application for conventional construction purposes to seal cracks or seams to provide a better appearance in covering these items. Minick discloses a method essentially consisting of: (1) dangerously heating and melt extruding a thermoplastic film-forming polymeric material from a first extrusion orifice to form, only upon cooling down significantly in temperature, a continuous, dimensionally fixed, elongate plastic strip; (2) further melt, high temperature co-extruding of a caulk mass from a second orifice to form a fixed dimentionally shaped continuous plastic body; and (3) materially and substantially cooling the resultant, combined, dimensionally fixed caulk strip for use in conventional sealing and covering applications.

The Tupper '178 reference discloses a method consisting of extruding a continuously formed filament-tubing having substantially fixed cross-dimensions while also in a dangerously heated, high temperature, workable plastic condition for largely conventional construction and welding applications. The extreme heat is necessary to the functionality of the Tupper method to prevent solidification of the extruded tubing. Any decorative application of Tupper's product must be brought about by applying an extremely hot plastic tubing directly to an article; or, in the case of utilization in Tupper as an integrating weld, for securing articles of plastic composition to one another.

The Bergland '624 reference discloses a method of packaging polyurethane sealant compositions, consisting of adding a small amount of curing inhibitor to a container over this type of sealant prior to sealing the containers with a lid or cap. Bergland references the effect of moisture only in so far as disclosing that single package polyurethanes were normally cured by exposure to the atmosphere where moisture reacts with the isocyanote groups, thereby cross-linking the composition; and that this reaction with the moisture in the atmosphere had caused problems with this type of sealant during its packaging and in its packaged state.

Bergland disclosed that the existence of any moisture initiated the curing process, which thereby prevented the caulking tube from operating properly because the cap or plunger could not freely move within the tube. The Bergland invention addresses problems related to moisture curable polymer urethane sealants with its object being to eliminate premature moisture curing of the polyurethane sealant while it remains packaged in its container.

In the present invention, polyurethane sealant is not an indicated or preferred material. The present invention distinguishably indicates the preferred utilization of acrylic latex caulk or siliconized acrylic latex caulk, which is a very different class of material compared to the polyurethane sealant. The use of water in the present invention acts upon the acrylic latex caulk material to slow and control the curing process such that the hardening curing process, which with acrylic latex caulk could take place within as little as an hour, is substantially slowed, and the caulk material is kept in a malleable state for a desired period of time for the artistic purpose intended, such that it can be effectively shaped and molded to an attractive ornamental configuration.

Distinguishably, polyurethane or urea formaldehyde foam is not a true caulking material; it is normally relatively slow curing, but is used often for filling large cracks because of its ability to expand. It can also be used as a filler before caulking. However, to the extent that the two substances bear any resemblance to one another at all, the effect of moisture or water is considerably different. Polyurethane sealant is a relatively slow curing substance whose curing rate is speeded up by premature moisture curing with the introduction of moisture or water, the problem that Bergland addresses. Acrylic latex caulk is a relatively fast curing caulk material normally which the method of the present invention slows down considerably such that it may remain in a malleable state for forming and shaping caulk configurations in accordance with the present invention and method.

The Backer '331 reference discloses a flower die apparatus for extruding cake flower designs, and is designed to address the problem of forming an entire flower in a one step operation for cake decorating purposes. U.S. Pat. No. 278,958 to Henay discloses an improvement in ornamenting structures, and relates to the formation of a continuous strip by forcing a plastic or semi-fluid material through a circular mouth piece on to a surface. The preferred substance utilized is disclosed to be a mixture containing whiting, raw linseed-oil, resin and glue.

None of the references specifically illustrate or teach the present invention. Nor is the present invention obvious in view of any of the prior art references listed herein. In addition, all of the prior art heretofore known suffer from a number of disadvantages:

(a) The prior art references do not disclose a device or method reasonably capable, without the utilization of high temperature and/or high pressure ranges of safely and economically forming or shaping a caulk body after its initial application into a dimensioned configuration.

(b) Certain of the prior art references require dangerously high temperatures in order to produce a single or composite body, or to apply a substance on to an article for seaming, welding or decorative purposes, such that special equipment apparatus is necessary to prevent a user or participant from serious injury.

(c) The prior art sets forth no specific method or approach, or device or system suggesting such a method, for treating a suitable caulk material with a water fluid in accordance with specific formulae on a special work surface under room temperature conditions, to achieve a delayed curing, such that small and larger durable, dimensionalized configurations can be fabricated by a workable, malleable precured caulk material for transfer and desired placement on an artistic exhibition surface such as a canvas.

(d) The prior art inventions provide no readily accessable equipment or easily utilizable method for fabricating durable, ornamental, dimensionalized caulk configurations, that are readily or easily useable by nontechnically trained or handycapped people, or which are readily utilizable without complicated and/or dangerous apparatus for such people.

(e) The prior art further suffers in not disclosing method of forming durable, dimensionalized caulk forms and figures which may be fabricated by hand, or which require numerically less, and less complicated, supporting equipment.

(f) The prior art further fails to disclose a method of fabricating a thin but durable caulk material background surface for use as a background surface on canvas and the like, for drawing and painting thereon, and for receiving other caulk-like forms and configurations, and other items, in various artistic and craft applications and embellishment.

(g) The prior art references also disclose no meaningful method or device for providing discernable stages of precuring and curing such that forming and sculpting additions or changes can be easily and safely made to a caulk material body over a period of time before the finally cured and hardened configuration is placed on an article or ultimate exhibition surface.

(h) The prior art additionally suffers from the inability to provide a method or apparatus, or any teaching from which such would be obviousness, which discloses or inhances any known characteristics in acrylic latex caulks, or other closely related caulks, to be effectively shaped or sculpted under room temperature conditions through a defined numerical relationship where the caulk material is effectively treated with water or a water fluid to create a slurry or colloidal state, to bring about a precured state whereby the caulk material could remain effectively malleable for periods of time providing the opportunity to fabricate a desired configuration.

Accordingly, it is the object of the present invention to provide a novel and expeditious method, utilizing a new use for acrylic latex caulks for fabricating a durable, dimensionalized ornamental configuration under safe room temperature conditions on a facilitating multilayer work surface for transfer to an exhibition surface.

A further object of the present invention is to provide an improved method for treating a suitable caulk material with a water fluid in accordance with special formulae on an improved multilayer work surface which enhances the effect of a water fluid upon a caulk material body, to achieve a measured and planned and reliable, delayed curing time, so that smaller and larger, durable dimensionalized configurations can be built and fabricated by a precured caulk material having enhanced and improved malleableness, workableness and shapeability, for transfer and desired placement on an artistic exhibition surface.

A further object of the present invention is to provide a method with a readily accessable and easy to use supporting equipment options capability, so that nontechnically trained and handicapped persons, as well as skilled-trained persons, can utilize the present invention, without the need for complicated and/or dangerous apparatus; to build dimensionalized caulk configurations, which can be fabricated by hand or simple, less complicated supporting equipment.

Yet a further object of the method of the present invention is to provide a meaningfully defined method for fabricating a thin but durable caulk material background surface for artistic exhibition surfaces such as canvas, and the like; where this constructed surface after early drying can be utilized to attach configurations made in accordance with the invention, or other forms and figures; and after additional drying, can be utilized for drawing/painting and other artistic-craft embellishment.

An additional object of the invention is to provide a method of fabricating acrylic latex caulk configurations which relies upon special discernible stages of precuring and curing so that desired forming, shaping and sculpting adoptations and additions can easily and safely be made to a caulk material body over a lengthened, advantageous work period, to add the particularly desired embellishment or configuration, before the finally cured and hardened configuration is completed and ready for transfer to an ultimate exhibition surface.

Yet an additional object of the invention is to provide a method and supporting apparatus to enhance the workable characteristics of acrylic latex caulks to be shaped or formed under room temperature conditions, where a defined numerical relationship is provided for effectively treating the caulk material with water fluid to create a slurry state to facilitate a precured condition where the caulk material can remain effectively malleable for lengthened periods of time for providing the opportunity to more accurately and completely fabricate a desired configuration, which would otherwise have been previously impossible in any expedient and safe manner under the old prior art technology.

SUMMARY OF THE INVENTION

The foregoing and other objects can be achieved with the present invention which is a method employing a new use of acrylic latex caulk material for fabricating a dimensionalized geometric configuration on a specially adopted multilayered work surface, facilitated by removeable and optionally additional membrane layer portions, for ultimate transfer to an exhibition surface such as an art canvas and other surfaces.

The method includes the step of adding a preselected amount of caulk material at room temperature to a special work surface within the perimeter of a chosen, selected configuration. A preselected amount of water fluid is then poured over the caulk material on the work surface.

The method then includes working in the water fluid into the caulk material so that a partial to substantial slurry mixture is initially and temporarily produced by the caulk material and the water fluid on the work surface.

The caulk material on the work surface is then precured for a selected period of time during which the caulk material changes from its slurry state and sets up at a partial hardness or cured state so that the caulk material remains solidly malleable. During this step the caulk material becomes partially attached to the top layer of the work surface.

The caulk material is then shaped, formed or sculpted to form a selected, dimensionalized caulk-configuration.

The method then includes secondary curing of this caulk configuration so that it then becomes substantially nonmalleable in hardness. During this stage of the method the bottom surface of the caulk configuration becomes securely attached to the top layer of the work surface to later facilitate a means of structural support and individual transfer to a chosen exhibition surface.

REFERENCE NUMERALS/LETTERS IN DRAWINGS

Figure 1:
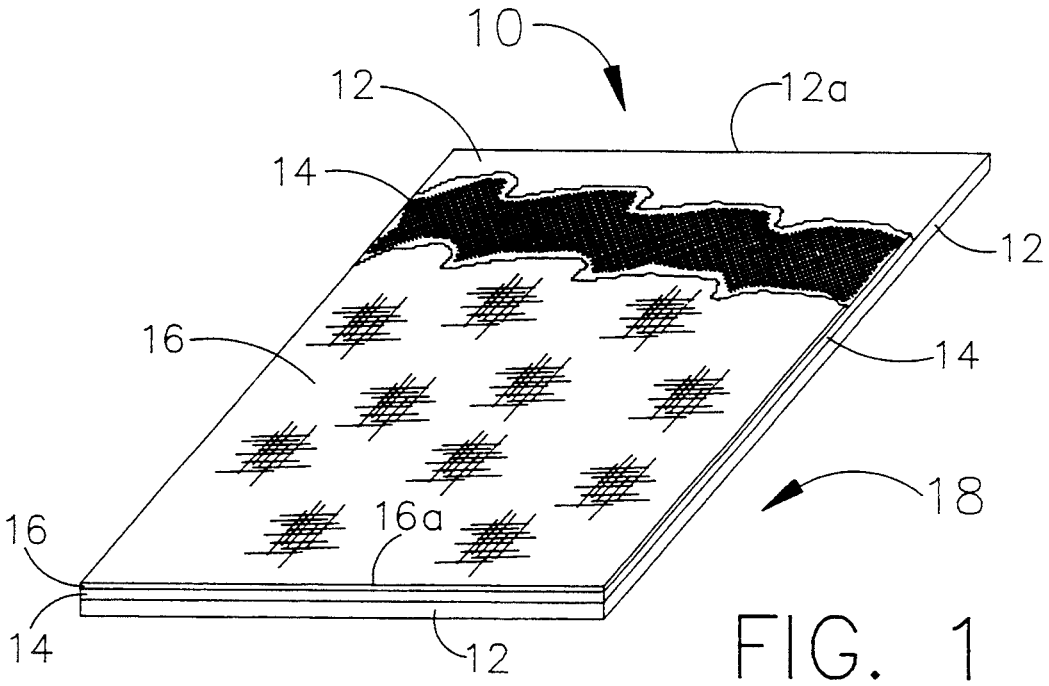
FIG. 1 is a top perspective view of a preferred embodiment of the work surface (10), a device of the present invention and utilizable in a preferred embodiment of the method of the invention.

| | | | |
|---|---|---|---|
| 10 | work surface | 12 | bottom layer portion (base) of (10) |
| 12a | top surface of bottom layer (12) | | |
| 14 | middle absorbent layer portion of (10) | 14a | top surface of middle layer (14) |
| 14b | bottom surface of middle layer (14) | | |
| 16 | top membrane layer portion (wax-paper like) of (10) | 16a | top surface of membrane (16) |
| 16' | segments/portions of membrane entering or becoming positioned in caulk body (20) or configuration (36) | | |
| 18 | ultimate supporting surface | 19 | adding step |
| 20 | acrylic latex caulk material (body) | 20a | perimeter line caulk portion |
| 20b | within-included caulk portion | | |
| 21 | lower surface portion of caulk body (20) (after curing) | 24 | pouring on/over (saturating) caulk (20) step |
| 27 | water container/reservoir | 26 | water fluid |
| 20/26 | partial to substantial slurry | 26' | hand (transfering-rubbing in water fluid) |
| 28 | working/rubbing-in fluid (20) step | | |
| 30 | precuring step | 32 | removable attachment portion of caulk (20) |

-continued

| | | | |
|---|---|---|---|
| | shaping step | | and membrane layer (16) secondary curing (step) |
| 36 | dimensionalized (shaped and formed) caulk configuration | 37 | lower surface of caulk configuration (36) |
| 37a | outer perimeter of lower surface (37)-lower surface perimeter | 37b | upper portion immediately above the lower perimeter (37a) of the configuration (36) |
| 38 | fixed attachment portion of lower surface (37) and membrane (16) | | |
| 40 | removing top layer membrane (16) from work surface (10) | 42 | cutting step |
| 43 | first membrane section of (16) | 46 | separating and removing step |
| 44 | second membrane section of (16) | | transfering step |
| 50 | exhibition surface | 52 | pattern layer |
| 54 | shaping and curving step | 56 | placing step (onto second membrane layer (58) |
| 58 | second membrane layer | 60 | bottom end opening of configuration (36) |
| 64 | secondarily adding | 68 | second acrylic caulk body |
| 76 | small dimensionalized caulk figure | 69 | adding step (small configuration production embodiment) |
| 70 | small caulk material body | 74 | pouring step |
| 75 | secondary curing step (small configuration production embodiment) | | small slurry |
| 80 | segment portion (on exhibition surface) | 80a | one end of portion (80) |
| | | 80b | second/other end of (80) |
| 89 | adding (background embodiment | 90 | caulk material (background embodiment) |
| 92 | work container or reservoir | 94 | mixing (step) |
| 90/26 | moderately thin slurry | 97 | conveying or transfering (slurry-90/26) to exhibition surface (50) |
| 98 | covered/covering exhibition surface (50) | 99 | dried/drying slurry (90/26) |
| 100 | art-utilizable, ornamental background surface | | |

DETAILED DESCRIPTION OF THE PREFERRED EMBODIMENTS OF THE INVENTION

The following description of the preferred embodiments of the concepts of this invention is made in reference to the accompanying figures. Where an individual structural element is depicted in more than one figure, it is assigned a common reference numeral, numeral and prime mark or numeral and small case letter, for simplification of identification and understanding.

The method of the present invention provides the ability to utilize a new use for acrylic latex caulk materials, of creating previously unknown, enhanced shaping and sculpting characteristics in the caulk material under room temperature conditions to fabricate a dimensionalized configuration and a background surface for realistic, artistic and ornamental exhibition purposes.

The preferred use in the present invention of acrylic latex caulk materials primarily includes acrylic latex caulking sealant material and acrylic latex caulk with silicone, also called siliconized acrylic latex caulk.

A representive, nonexhaustive list of some of the conventionally available acrylic latex caulk materials which can be utilized in the method of the invention include the trade designations known as: Bostic Chem-Calk 600, Contech, D.A.P. Rely-On, Easy Caulker, Geocel Sempra, H. B. Fuller Caulk-In-Color, Macco Acrylic-Latex 137, Miracle Acrylic-Latex, OSI Acrylic-Latex Caulk, Plio-Calk, Red Devil Life Time1, Seamseal 2002 Acrylic-Latex Caulk, Synko and UGL Acrylic-Latex Caulk each of which are U.S. trademarks.

It will be understood that many other related and similar acrylic latex caulk material products can be successfully utilized in the present invention; including those conventionally available siliconized acrylic latex caulk materials, including by their currently available trade designations: Contech Siliconized Caulk, Cuprinol Outdoor Caulk, D.A.P. Acrylic Latex with Silicone, Dow-Corning Silicone Plus, GE Silicone II, Geotech Construction 1100, Life Time II, Macco Insul Caulk, Macco Super Caulk, OSI Siliconized Acrylic Latex, Red Devil Life Time II, Synco Siliconized Acrylic Latex and UGL 25 Year Lasticaulk, each of which is a U.S. Trademark; and many other available related siliconized acrylic latex caulk material products.

Figure 2:
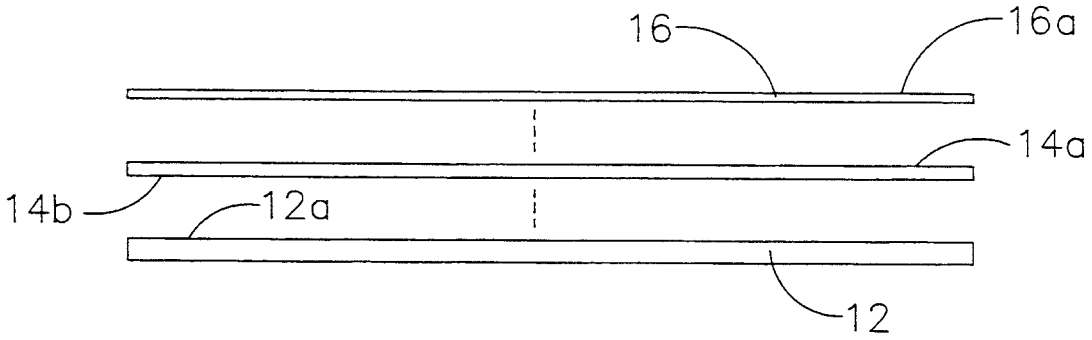
FIG. 2 is an exploded side view of a preferred embodiment of the work surface of the method and invention.

Referring now to the drawings, and more particularly to FIGS. 1 and 2, thereof, there is illustrated a specially adopted novel, multilayered work surface at 10, for building and fabricating a dimensionalized geometric caulk configuration, and assisting in facilitating the method of the present invention.

The work surface 10 of the present method is provided with three removable, juxtaposed layers, including a bottom layer portion 12, a middle absorbent layer portion 14 and a top membrane layer portion 16.

The bottom layer 12 is preferably a solid resilient card board section which can be substantially flattened upon an ultimate ground or ambient supporting installation surface 18. It will be understood, however, that a multitude of different hardened base or support surface materials can be utilized as the bottom layer 12 of the work surface 10, including, but not limited to, wood, pliable, hard substances and materials, metal, polymer, alloy, mixed compositions, and many other types of substantially and/or temporarily hard or resilient, or semi-malleable substances, materials and/or fluids.

The method of the present invention includes fabricating the work surface by first installing, placing or laying down the bottom layer 12 onto an ultimate supporting installation surface 18. The fabrication of the work surface 10 then includes adding onto the top surface 12*a* of the bottom layer 12, as a second layer, the layer 14. Preferably, the middle layer 14 is an absorbent, compressable paper material such as conventional paper toweling material, although many absorbent materials can be utilized. The middle layer 14 is provided with a substantially absorbent top surface 14*a* and bottom surface 14*b*.

The fabrication of the work surface 10 is then completed by the step of additionally adding on top of the second-middle layer portion 14; a semi-transparent, third top membrane layer portion 16. The top membrane layer 16 is preferably a polymer, wax or paraffin coated or surfaced paper-type material such as, preferably, wax paper, but may be any number of such treated or composition-materials, having transparent or semi-transparent characteristics preferably, or opaque or semi or partially opaque.

The top membrane layer 16 is regarded as a membrane layer, in fact, in the method of the present invention, in that it is easily and flexibly flattened and/or shaped or formed, to serve as a covering and top layer of the work surface 10; and, upon treatment of the caulk material as hereafter set forth, it has been found utilizing the method of the present invention that the membrane layer or membrane 16 becomes a porous, permeable or semi-porous/permeable membrane, after a short to moderate time such as 10 to 20 minutes, allowing moisture, liquid or fluid, such as in the form of liquid water molecules, to pass through the membrane 16 to the middle absorbent layer 14, which it was, otherwise, for a period of time before that, or upon first being introduced, not able to do. In so doing, in the present invention and method, the membrane becomes a delayed semi-permeable membrane which helps to serve the purpose of the method in helping to properly utilize a water fluid.

The membrane 16 thus provides a stable holding barrier, reservoir or channel for moisture or a water fluid to act upon a caulk material placed or applied on the membrane 16, as described in detail later herein. It then, after a short to moderate relative range of time, permits the fluid to drain from the caulk material and top surface 16*a* of the membrane 16, draining to the middle absorbent layer 14.

The phenomenon of a temporary water or fluid holding action followed by a permeable-like drainage provided by the membrane 16, appears to be due to the fact that the polymer, wax or paraffin coating or surfacing on the membrane 16 utilized in the invention, though originally designed conventionly to hold water and moisture out, wears down or ceases to function characteristically upon exposure to or prolonged saturation by the presence of water or moisture, and eventually allows a liquid or fluid to flow through the membrane 16 in part or whole. Once seeping or drainage begins from or through the membrane 16, such drainage appears to be further facilitated by the pressure gradient (or pumping action) and other absorbtive characteristics provided by the middle layer 14. A preferable material for use in the middle layer 14 is particularly good or strong, absorbent paper toweling, although it will be recognized that a number of spongy, compressible or porous absorbent materials can be used, as well as certain fluid or solid layers having absorbent qualities.

The phenomenon of the temporary moisture holding or sealing action of the membrane provides the important period of time necessary, as set forth later, to treat the caulk material, and, in the referenced preferred embodiments, to transform the caulk into a slurry which is drained as indicated and transformed to later facilitate a pre-cured, malleable material which can be more effectively and responsively formed, molded or sculpted—a use to which acrylic latex caulk materials have never been applied because of their original conventional design for very different purposes such as sealing; and because of their characteristic, normal disdain for water and relatively quick curing times.

Part of the top membrane layer 16 also serves later in the method as a fixed covering of a bottom portion of a caulk configuration, as described in detail later herein. The top membrane layer 16, therefore, serves a dual purpose in the present method and invention in acting as a membrane for the work surface 10, and later, in part, as an attached and fixed membrane for a molded or shaped caulk configuration which was originally fabricated on the membrane layer 16 of the work surface 10.

As indicated, the top surface 16*a* of the membrane layer 16 serves in part to receive the caulk material utilized in the present method.

Figure 3:
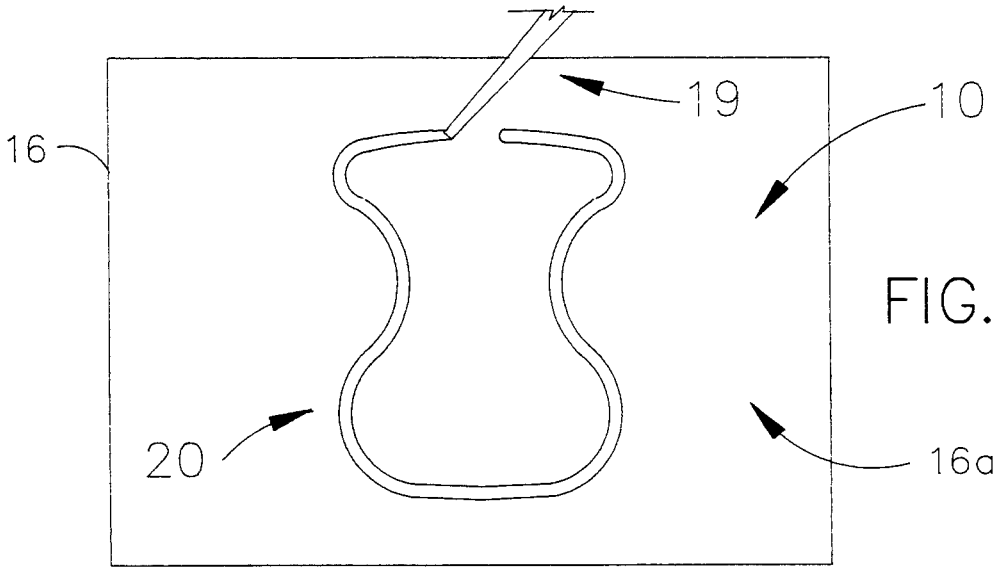
FIG. 3 illustrates an early stage of the adding step (19) of a preferred embodiment of the method of the invention.
Figure 4:
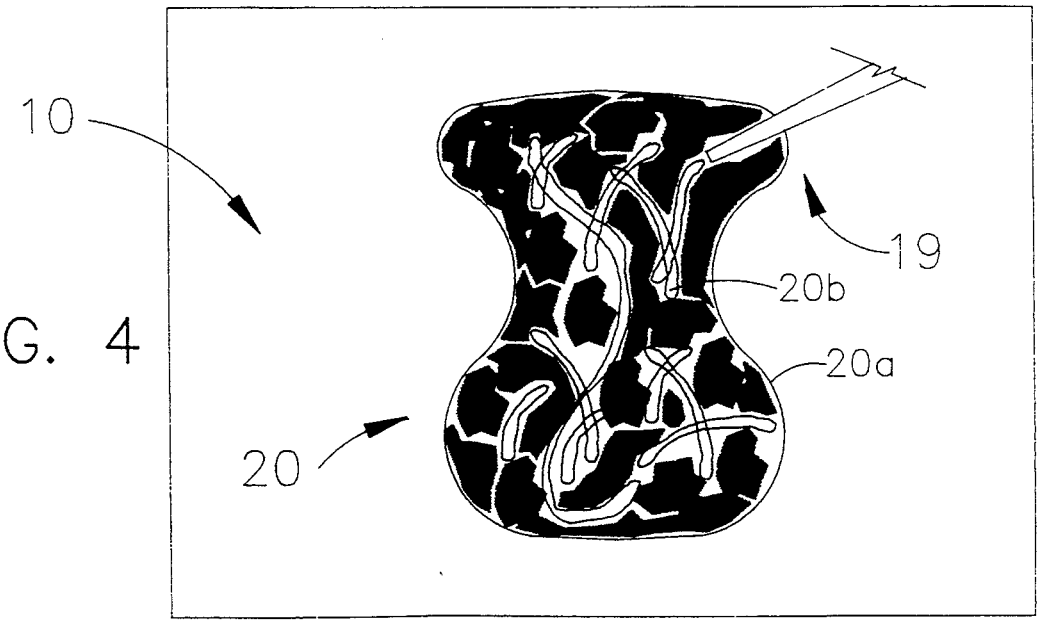
FIG. 4 illustrates a later stage of the adding step (19) of the invention.
Figure 5:
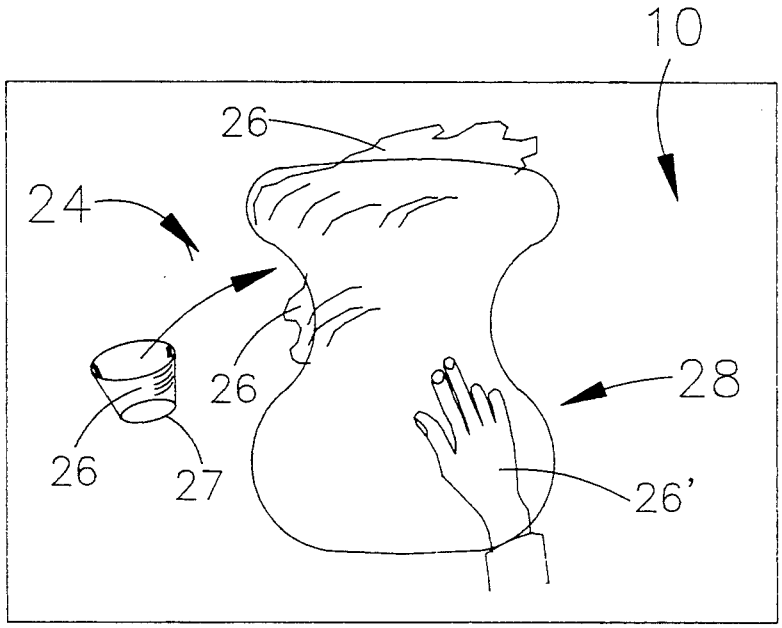
FIG. 5 illustrates an early stage of the pouring step (24) of a preferred embodiment of the invention.

Reference is made to FIGS. 3, 4 and 5. Accordingly, after fabricating the work surface 10 of the present invention, the method includes adding 19 a preselected amount of acrylic latex caulk material body 20 under room temperature conditions to the top surface 16*a* of the membrane layer 16 of the work surface 10; starting with applying a perimeter line caulk portion 20*a* of caulk 20 along a contemplated outside perimeter line of a chosen or planned form, figure or configuration; and contemporaneously adding within-included caulk portions 20*b* of caulk 20 within the perimeter 20*a* to fill in, flatten the portions 20*a* and 20*b*, and reasonably establish a contemplated or planned configuration, as illustrated generally in FIG. 4.

Figure 6:
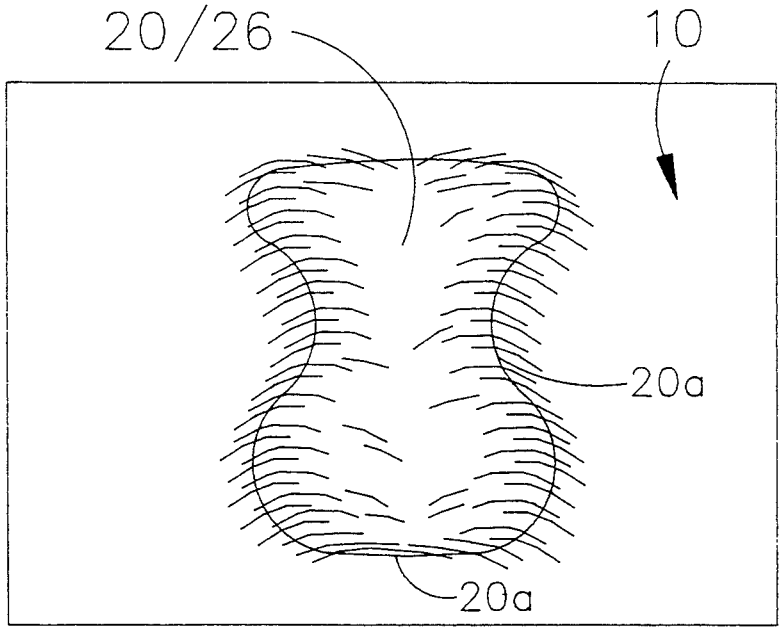
FIG. 6 illustrates a later stage of the pouring step (24), focusing on the slurry element (20/26).

The method then includes pouring 24 on or over the caulk material 20 (20*a* and 20*b*) a preselected amount, weight or volume, of water fluid 26; and working or rubbing in 28 the fluid 26 into the caulk material 20; as illustrated in part in FIGS. 5 and 6 respectively. In carrying out the working-in step 28 of the present method on the work surface 10, a partial to substantial slurry 20/26 initially and temporarily materializes as illustrated in part in FIG. 6 while still generally retaining the perimeter portion 20*a* of a contemplated figure.

The water fluid in the present method of the invention is preferably a selected amount of common tap water. However, a number of other substances partially or substantially mimic water chemically with respect to such properties as polarity, dielectric constant, heat capacity and solvent and reactive qualities, and some of these substances could be used in the present invention. Additionally, a number of largely water based mixtures, compositions or substances; or moderately to strongly hydrophilic ("water loving") substances can be appropriate for use in the present method.

The method of the invention additionally includes, after the working-in step 28, the step of precuring 30 the caulk material body 20 for a selected period of time during which the caulk body 20, including the perimeter portion 20*a*, kept substantially intact during the pouring step 24, sets up at a partial hardness in a precured state. In the precured state, the caulk 20 becomes and remains substantially malleable. Also, during the precuring step 30, and included time period, the top membrane layer 16 becomes partially and semi-releasably attached to the lower surface portion 21 of the caulk body 20, after precuring. The caulk material body 20 therefore becomes partially secured to the top membrane layer 16 of the work surface 10, a long the lower surface portion 21, as illustrated generally in part as a removable attachment portion 32 in FIG. 7.

After precuring as indicated, the method additionally includes a shaping step where the caulk material 20 is shaped, formed and/or sculpted to form a final-staged, contemplated, chosen or selected, dimensionalized caulk configuration 36. Because of the remaining malleableness as described by virtue of the precuring step 30, it is convenient and relatively easy to still shape and form the caulk body 20 to form the selected caulk configuration 36. It will be understood that many different and diverse configurational forms and dimensionalized shapes may be chosen and employed during the shaping step to form and produce the desired caulk configuration 36, including individual portions to be later cantilevered above and not in contact with a chosen exhibition surface when it is transfered for final placement and positioning for exhibition, as described in detail later herein.

The method also includes secondarily curing the caulk configuration 36 for a selected period of time during which the caulk configuration 36 becomes considerably harder and substantially nonmalleable. Additionally, during this secondary curing step, the lower surface 37 of the now formed caulk configuration 36, of what was the lower surface 21 of the caulk body 20, but now has become the lower surface 37 of the formed caulk configuration 36; becomes substantially attached and securely fixed to the membrane layer 16 of the work surface 10, as illustrated in part generally as fixed attachment portion 38 in FIG. 8.

Figure 7:
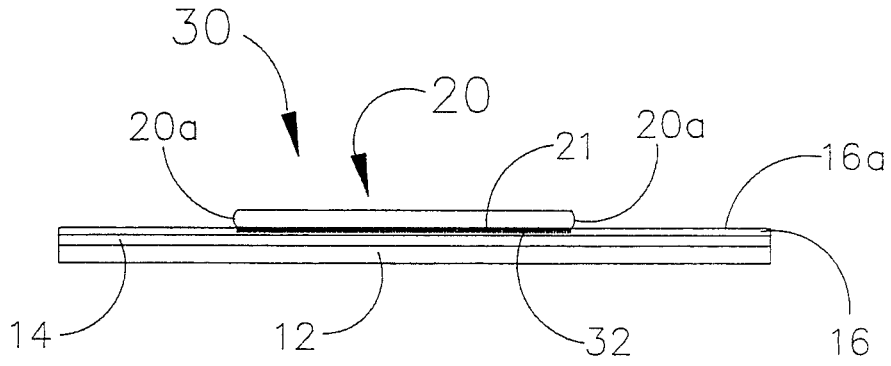
FIG. 7 is a side view of the work surface and caulk material body, illustrating part of the precuring step (30) of a preferred embodiment of the method, showing a removeable attachment portion (32) of the caulk body.
Figure 9:
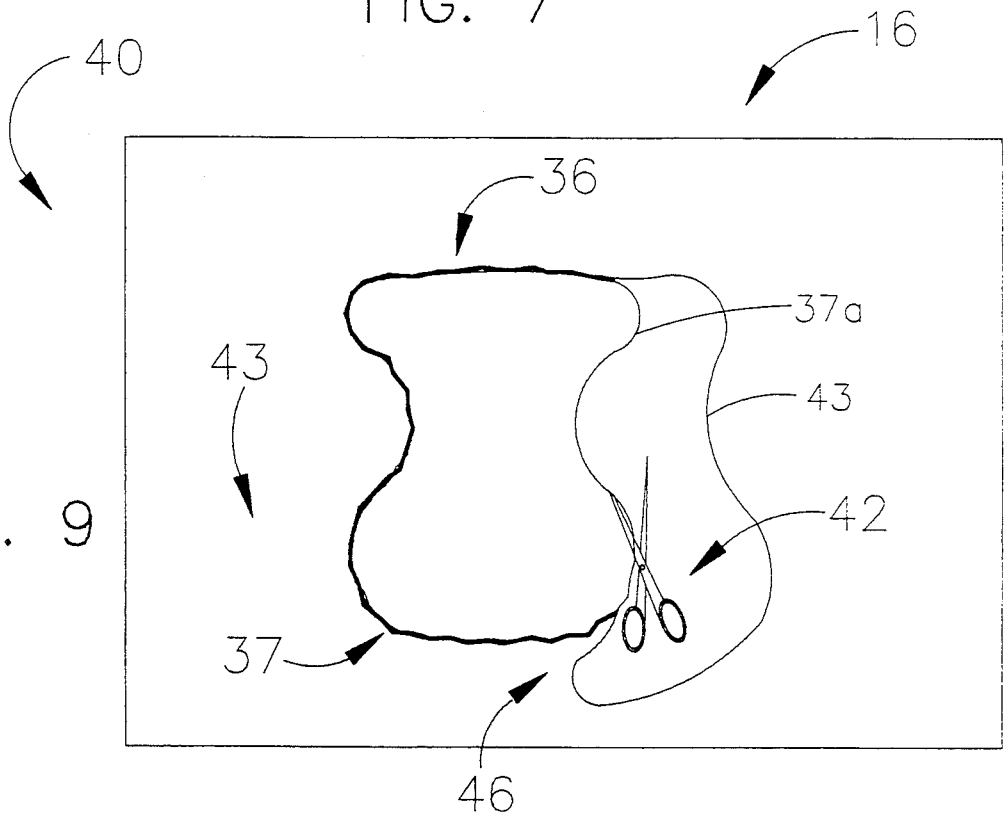
FIG. 9 illustrates part of the cutting step (42) of a preferred embodiment of the method of the present invention.
Figure 8:
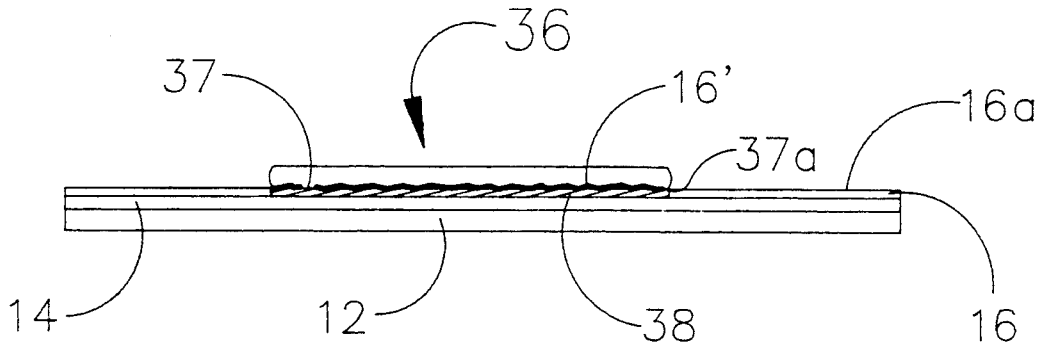
FIG. 8 is a side view of the work surface illustrating the fixed attachment portion of the dimensionalized configuration (36).

Also, in referencing FIGS. 7 and 8, it should be noted, as illustrated, that segments or portions 16' of the membrane layer 16 can enter and become removeably or securely attached in the caulk body 20 and the caulk configuration 36, respectively; rather than becoming fixed conterminously with the lower surface 21 of the body 20 or the lower surface 37 of the caulk configuration 36, as illustrated.

A preferred embodiment of the method of the present invention includes, after the secondary curing step, the step of removing 40 the top membrane layer 16 of the work surface 10, which continue to support the caulk configuration 36; and cutting 42 along the outer perimeter 37*a* of the lower surface 37 of the configuration 36 to remove the caulk configuration 36 from the surrounding portions of membrane layer 16.

In the process of proceeding with the cutting step 42, the membrane 16 is separated into a first membrane section 43, outside the outer perimeter 37*a* of the lower surface 37 of the configuration 36; and a second membrane section 44, a part of and inside the lower surface perimeter 37*a* of the configuration 36.

As the method then proceeds, the first membrane section 43 is separated and removed 46 from around and in contact with the lower surface perimeter 37*a* of the configuration 36, having been cut 42 therefrom. In so doing, the second membrane section 44 remains securely attached to, part of and/or within the lower surface perimeter 37*a*, and provides support and waterproofing to the configuration 36 when it is substantially cured and while it is still curing.

The configuration 36 is then transferred or conveyed to an exhibition surface 50 such as an artistic canvas, or any of a diverse number of other exhibition surfaces, for positioning and fixed placement thereon.

Figure 10:
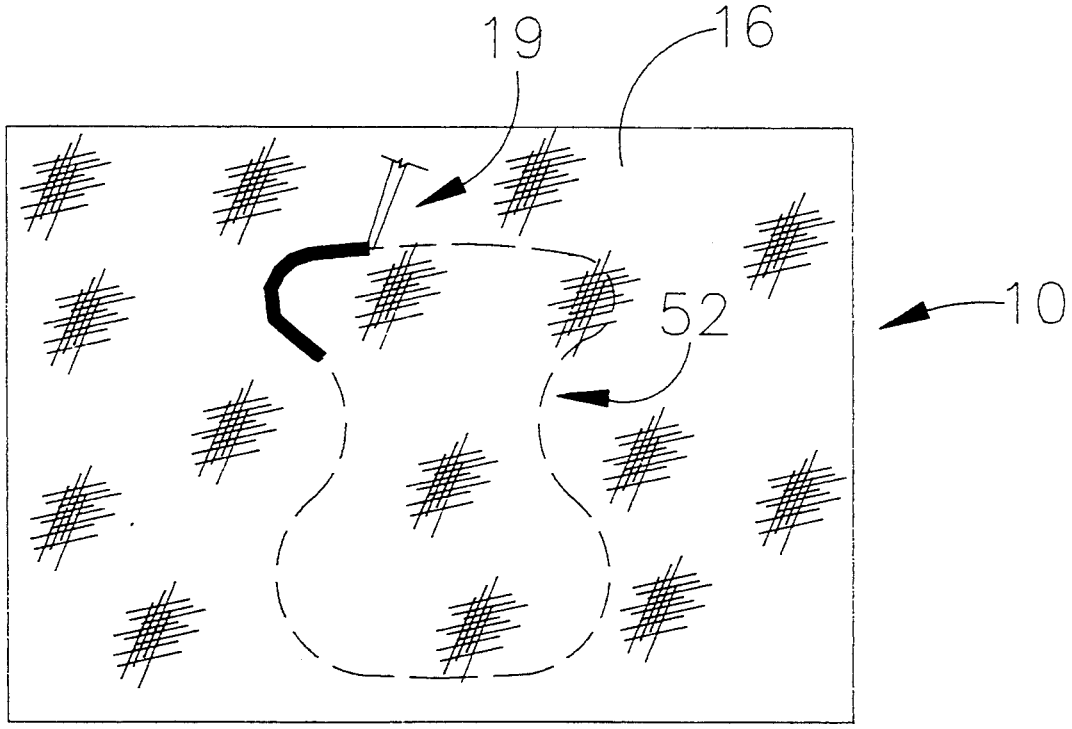
FIG. 10 is a top view of the work surface (10) employing the pattern layer (52) of a preferred embodiment of the invention, and illustrating part of the adding step (19) of a preferred embodiment in utilizing the pattern layer.
Figure 11:
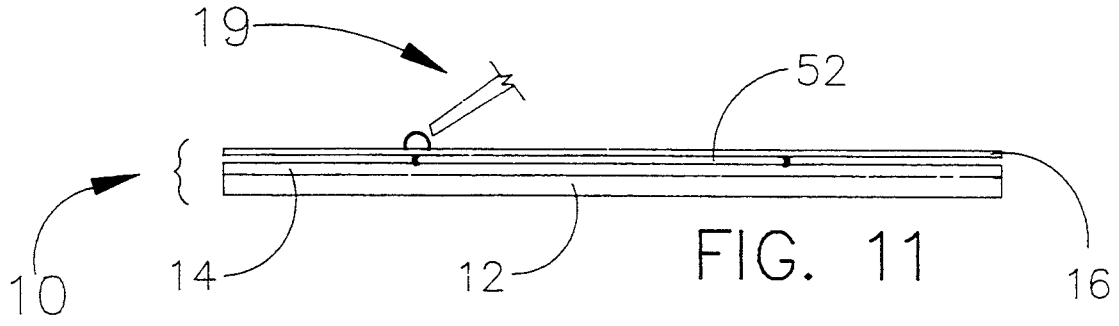
FIG. 11 is a side view illustrating the pattern layer as a part of the work surface in a preferred embodiment, and part of the adding step of the method.

Reference is made to FIGS. 10 and 11. As briefly described earlier herein, the work surface can be provided with an additional pattern layer 52. The pattern 52 can provide a silhouette, or an outline perimeter or profile of a desired or planned configuration which can be viewed through a transparent membrane 16 when adding 19 caulk material body 20 to the work surface 10. As illustrated, the pattern 52 is inserted or placed between the removeable second middle layer portion 14 and the removeable top membrane layer portion 16.

Figure 12:
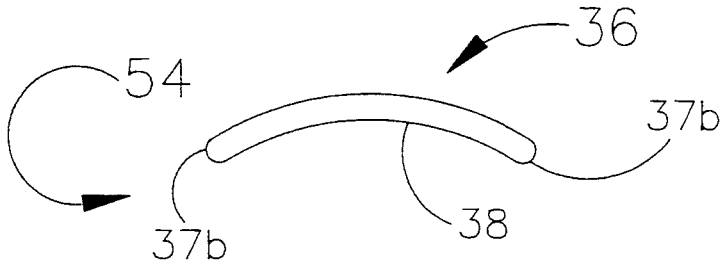
FIG. 12 is an isolated side view of a caulk configuration, illustrating in part the shaping and curving step 54 of a preferred embodiment.

Additionally, the method of the present invention in a preferred embodiment thereof can include after removing 46 the first membrane portion 43 from the lower surface perimeter 37*a* of the formed caulk configuration 36, and before transfering the configuration 36 to an exhibition surface, the additional step of shaping and curving 54 the lower surface perimeter 37*a* area and the upper portions 37*b* immediately above the lower perimeter 37*a*, downwardly and underwardly toward the configuration's lower surface 37, as illustrated in part in FIG. 12. In so doing, the fixed membrane portion 44 is more securely fixed into position along the perimeter 37*a*, which has been further molded to the extent possible in the shaping and curving step 54.

Figure 13:
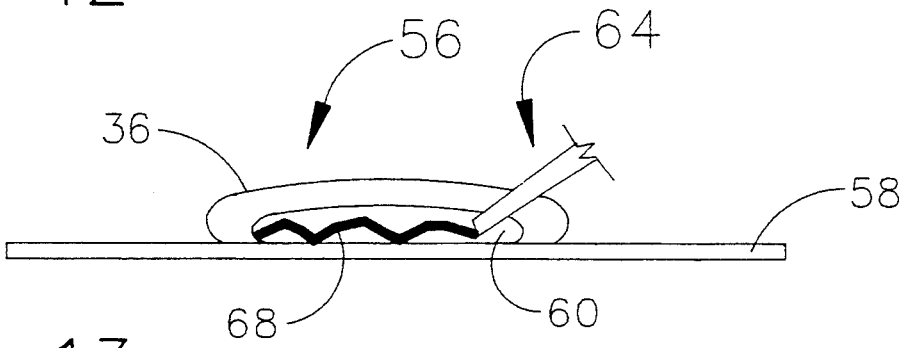
FIG. 13 is a side view illustrating in part the placing step (56) and the secondary adding step (64).
Figure 14:
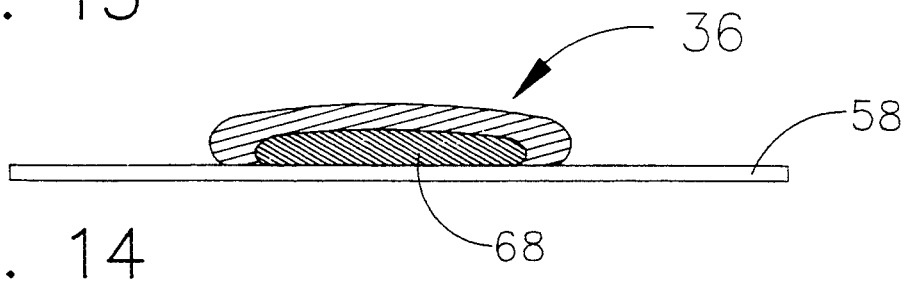
FIG. 14 is a side view of the configuration and second body of a preferred embodiment of the present method and invention.

Reference is made to FIGS. 13 and 14. Additionally, the caulk configuration can be placed 56, after shaping and curving 54, onto a separately provided, second membrane layer portion 58, such as preferably wax paper, or on flattenable materials such as, or similar to, those options for such materials described earlier; after which the bottom end opening 60 of the caulk configuration 36 can be filled in by secondarily (or secondary) adding 64 a selected amount of a second caulk body filling 68 to completely or substantially fill the bottom end opening 60, as illustrated in part in FIG. 14.

Figure 15:
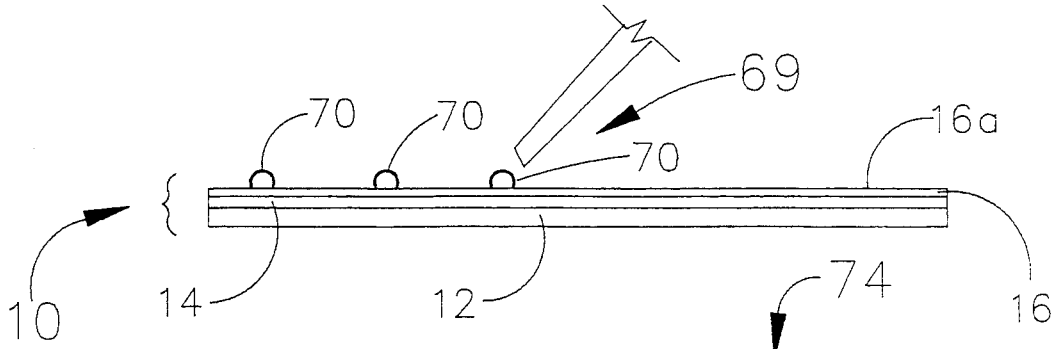
FIG. 15 is a side view illustrating in part the adding step (69) of a preferred embodiment of the method.
Figure 16:
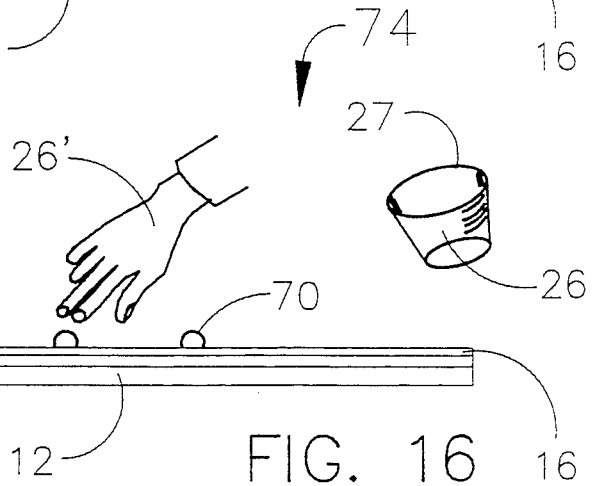
FIG. 16 is a side view illustrating in part the hand facilitated rubbing-in of fluid (28) along with the pouring step (74) of a preferred embodiment of the invention.
Figure 16A:
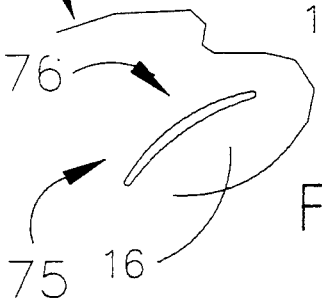
FIG. 16A is a side view illustrating the small dimensionalized figure of a preferred embodiment after the shaping and forming step (54).

The method and new use for acrylic latex caulk materials may also be utilized to produce and fabricate a small dimensionalized caulk configuration 76 on the previously described multilayered work surface 10 for transfer 47 to an exhibition surface 50, as illustrated in part generally in FIGS. 15, 16A and 16, and previously illustrated in part in FIGS. 1 through 6. Most of the same steps and details are involved when the present method is utilized to produce smaller configurations as indicated by some of the same numbered elements set forth, in keeping with the convention of the specification herein, and illustrated in part in FIGS. 15 and 16.

Some slight adoptations come into this preferred embodiment of the present invention. For example, the adding step in this embodiment, adding step 69 for this embodiment, involves adding a small preselected amount of caulk material body 70 to the top surface 16*a* of the membrane layer 16 on the work surface 10. The pouring step 74 in this embodiment includes transfering small amounts of water fluid 26 from a water fluid container 27 to the caulk body 70 by hand 26', or by hand implement or tool, as illustrated in part in FIG. 16. The water 26 is then worked in 28 similarly as previously described and illustrated to produce a small slurry. The precuring step 30, and the shaping step 24 are also similar in this embodiment, except that they involve the specific measurements, characteristics and dynamics of a small caulk material body 70 and a small dimensionalized caulk FIG. 76, as will be described later herein in further detail in the Exemplars further illustrating the invention. The secondary curing step 75 of this embodiment includes curing the caulk FIG. 76 so that it becomes only partially to moderately nonmalleable in hardness so that it may still be completely removed from the membrane layer 16 without remaining residue or small amounts of membrane, as described by example earlier as segments or portions of membrane 16', nonreleasably sticking to the FIG. 76 after curing 75.

Also, as an option within this embodiment, the caulk body 70 can be removed from the membrane 16 soon after precuring 30, and then transfered to the exhibition surface 50 and positioned and secured thereon as desired, for possibly constructing a larger overall configuration as illustrated in part herein; and then secondarily cured 75 while in position on the exhibition surface 50. This can also facilitate the attachment of the caulk body 70 to the surface 50. The caulk body can then, or in the process of so attaching, be shaped 34 into a small dimensionalized caulk figure. Optionally and preferably, if this mode of the embodiment of the method is selected, the caulk body 70 is removed from the membrane 16 after precuring 30 and shaped 34 thereafter into a desired small dimensionalized FIG. 76, which is then transfered 47 to the exhibition surface 50, as indicated and desired, and secondarily cured 75 while positioned and attached on the exhibition surface 50.

Preferably in this present embodiment of the method of the present invention, the FIG. 76 is secondarily cured 75 before positioning on the exhibition surface 50, and is then, after secondary curing 75, transfered to an exhibition surface 50, similarly as described and illustrated for the embodiment already described for larger dimensionalized caulk configurations 36.

Figure 17:
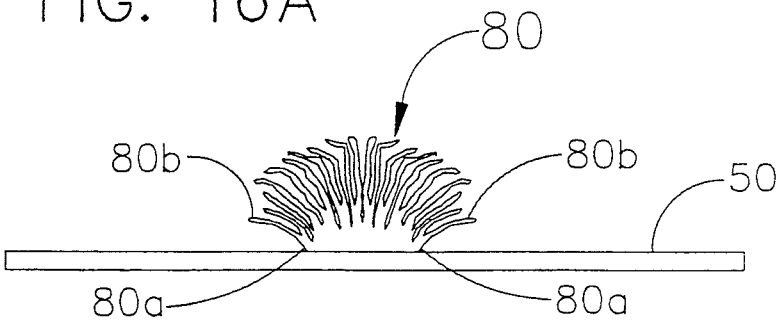
FIG. 17 is a side view illustrating segment portions durably attached and cantilevered with respect to the exhibition surface, of a preferred embodiment.
Figure 18:
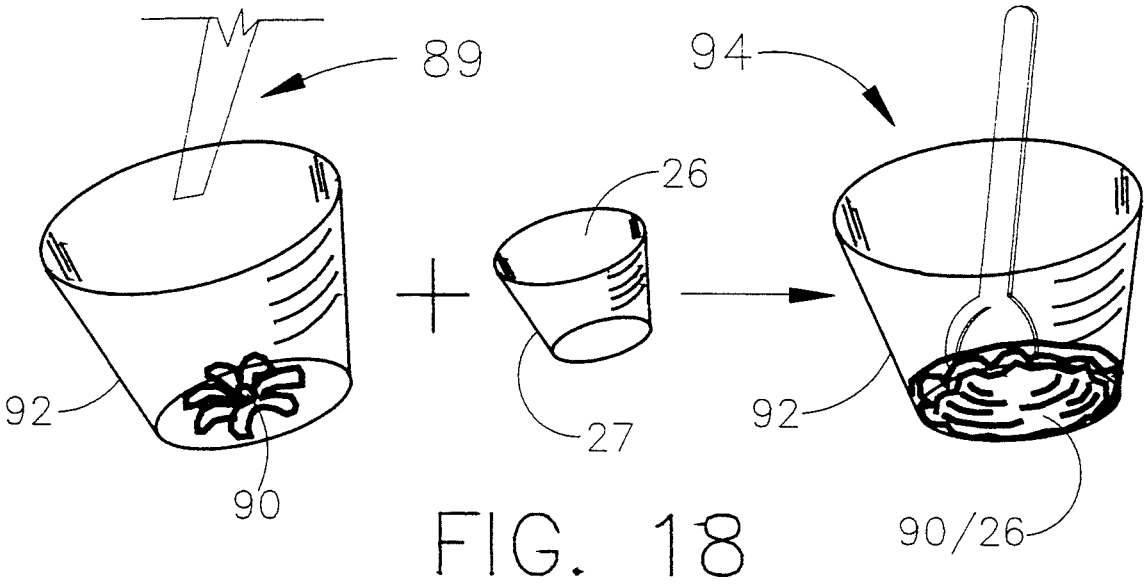
FIG. 18 illustrates part of the adding (89) and mixing (94) steps of a preferred embodiment of the method of the present invention, and the formation of the slurry (90/26).
Figure 19:
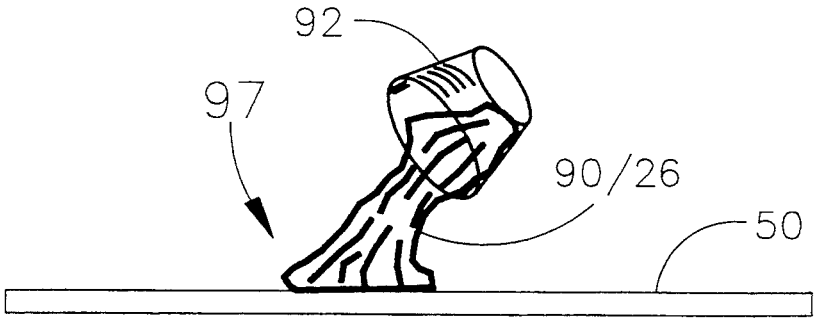
FIG. 19 illustrates in part the conveying and pouring step (97) of a preferred embodiment.
Figure 20:
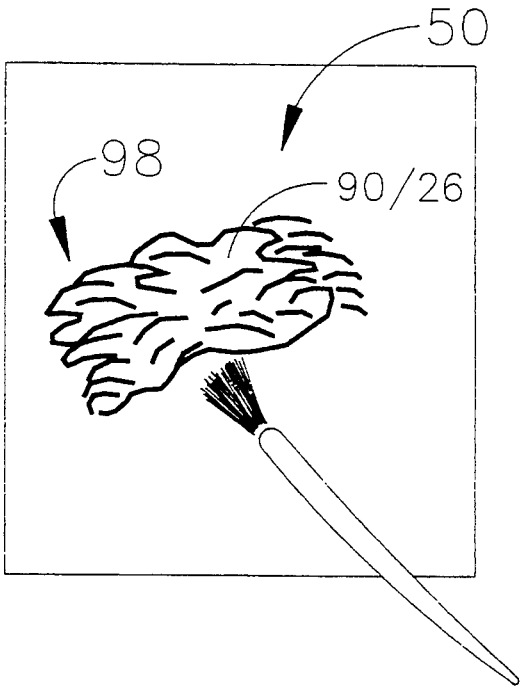
FIG. 20 illustrates a top perspective of the covering surface step (98) of a preferred embodiment of the method.

Additionally, in the embodiment for production utilizing the present method of smaller caulk FIGS. 76, the FIGS. 76 can be transfered after precuring 30, shaping and secondary curing, as preferred, to an exhibition surface 50 such as canvas, and positioned together in individual segment portions 80 to make up an arrangement such a bloom or flower so that each portion 80, or plurality of such portions, are supported at one end 80*a* on the exhibition surface 50, attached or secured thereto, or on another portion 80 or group thereof, and the second or other end 80*b* is cantilevered above and not in contact with the underlying exhibition surface 50, as illustrated in part by example in FIG. 17.

In an additional preferred embodiment of the present invention, the method is utilized in employing the new use of acrylic latex caulk material, for fabricating and constructing at room temperature an ornamental, art-utilizable background surface on an exhibition surface 50. This background surface, upon completion, can be utilized as a surface for drawing, painting, other artistic-ornamental uses, and positioning and attachment of dimensional figures of the present invention, among many other uses.

Accordingly, reference is now made to FIGS. 18, 19, 20, and 21. This embodiment of the method of the present invention includes adding 89 a preselected amount of caulk material 90 to a work container or reservoir 92, and mixing 94 with the caulk 90 a preselected amount of water fluid 26 so that, and until, the caulk material 90 and the water fluid 26 form or substantially become a moderately thin slurry 90/26, or slurry-like substance or substance characterizing in part or in whole a dilute to thicker suspension of solids in water or water fluid 26, or thin to thicker aqueous dispersions, or semi-paste/fluid mixture and/or partial composition.

The slurry 90/26 is then conveyed or transferred 97 to an exhibition surface 50, and the surface 50 is covered 98 so that the slurry 90/26 is spread substantially over the surface 50 in a light to moderate thickness, preferably. The slurry can also be prepared under the present method and administered covering 98 the exhibition surface 50 in a heavy consistency.

Figure 21:
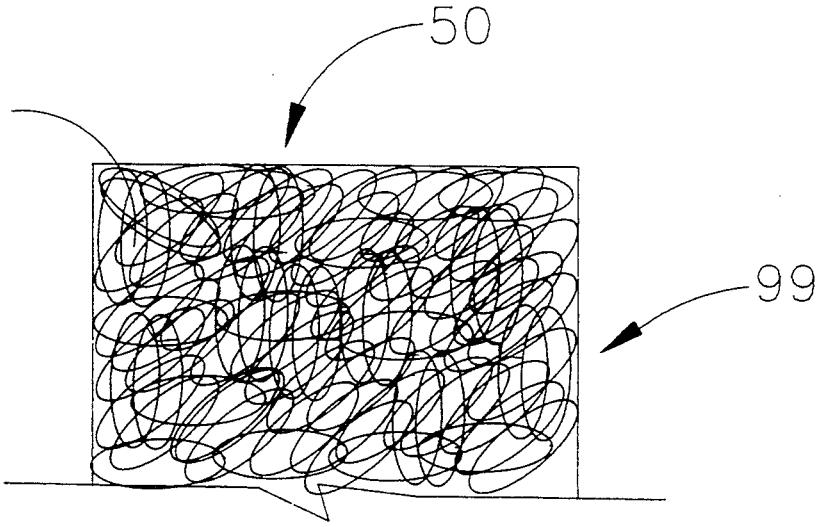
FIG. 21 illustrates in part, the covered (98) exhibition surface and the dried or drying (99) art-utilizable, ornamental background surface (100) of a preferred embodiment of the method of the invention.

The slurry 90/26 is then dried 99 on the exhibition surface 50 to form an art-utilizable, ornamental background surface 100 on an exhibition surface 50, as illustrated by symbolic example in FIG. 21.

Figure 22:
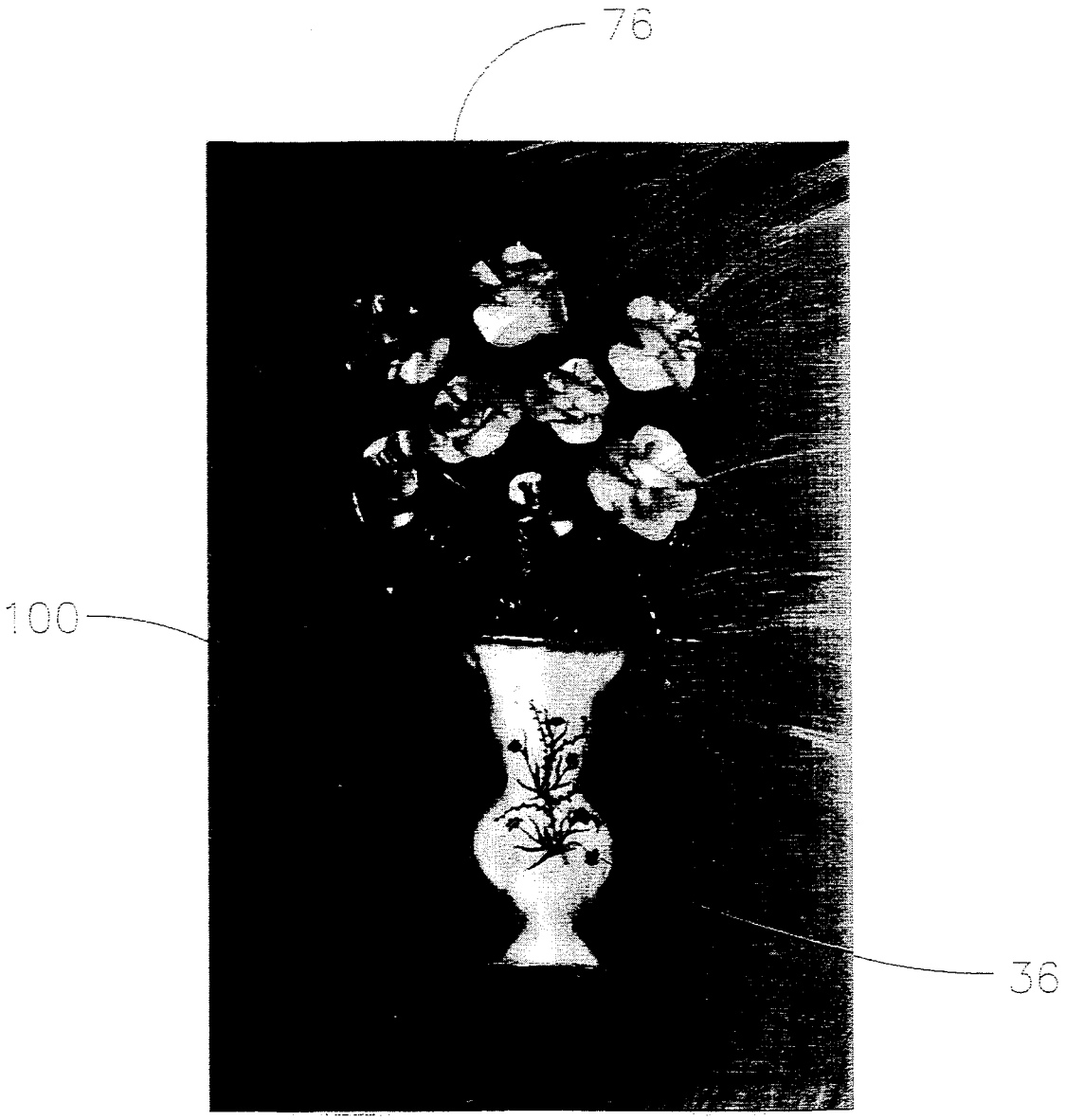
FIG. 22 is a black and white photograph illustrating the ornamental effects of several preferred embodiments of the invention.

FIG. 22 shows the ornamental effects of utilizing three preferred embodiments of the method of the invention, as facilitated by the work surface 10. Shown in FIG. 22 is an example of a dimensionalized caulk configuration 36, a small dimensionalized caulk FIG. 76 and an ornamental background surface 100 (just described herein).

EXEMPLARS

The method and products thereof of the present invention are further illustrated by the following examples. In most cases unless otherwise indicated, numerical references include units of weight and equivalent amounts or units of volume or other equivalent units. The numerical ratio or percentage relationships are set forth as parts related to one another in an entire or whole amount of the substances involved in combined weight or amount.

EXEMPLAR I

In the pouring step 24 and the working-in step 28, the preferred water fluid 26 used is warm tap water. In a grouping of trials, the preselected amount of water 26 found to be preferably used in pouring 24 over the caulk body 20 is computed to be in accordance with the equation: $y=0.315146678x+(-8.058193007)$, or about $0.32x-8.06$, where "x" equals the units of weight, or equivalent units of volume, of the caulk material 20, where x equals a number greater than about 25.000; and "y" equals the weight of the water 26 utilized, in the originally chosen units, or the equivalent units of volume. In this example, the caulk configuration 36 produced was a preferred consistency, flower vase-like structure. As a part of this example, it is found to produce a preferred workable, shapeable and malleable vase-like structure, when pouring 24 over about 110.4 grams of the caulk material 20, about 26.73 grams (equivalent to about 26.7 milliliters $H_2O$). Another related use involved pouring on 24 about 17.1 grams of water 26 with 79.9 grams (pouring 24 and working-in 28). A number of additional trials produced substantially consistent results, using between about 70.0 grams and 120 grams of caulk material 20, when analyzed mathematically through linear regression after a number of groups of such trials.

A preferred amount of time for precuring 30 is in the range of about 9 to about 12 hours, with the use of the present embodiment of the method such that the caulk body 20 remains malleable for shaping in accordance with the method. Many tests conducted with caulk not treated in accordance with the present method, resulted in nonmalleable and hardened consistency in a range of time of no more than one (1) to two (2) hours, such that such materials could not be shaped or molded to a fixed and durable position or form.

Additionally it is found in utilizing the present method that during or over the precuring 30 time period, as indicated, the caulk material 20 will lose an average of about 10.1% of its original starting weight prior to precuring 30 while still remaining substantially malleable, having a range of loss of weight of from about 8.5% to about 11.7%; and that this together with, or separate from, the indicated precuring time, can be an indicating or defining factor for determining or measuring the time or amount preferred for precuring 30.

EXEMPLAR II

It is found in a number of trial-uses utilizing a preferred embodiment of the invention, that a preferred vase-like configuration 36 product was produced by the method when, in the pouring step 24, the preselected amount of water 26 was determined in accordance with the ratio relationship, where about one part of water 26, by weight or equivalent volume, was used with a defined range of caulk material 20 of between about 2.8 parts to about 5.0 parts by weight of caulk material 20 during the pouring and working-in steps, 24 and 28 respectively, prior to precuring 30.

EXEMPLAR III

A number of additional trials utilizing the present method to produce flower vase-like configurations 36 structures and the like of a number of different sizes, produced a substantially preferred configuration 36. The results of these trials had a substantial correlation, indicating that in the pouring step 24 of this embodiment of the method and invention, the preselected amount of the water fluid 26 utilized is determined in accordance with the equation: $y=0.19828x+5.38314$, or about $0.19x+5.38$, or about $0.2x+5.4$, where x equals the preselected number of chosen units of weight of the caulk material 20, and y equals the units of weight of water 26 utilized, or the equivalent value in units of volume.

EXEMPLAR IV

In a set of trials involving the production of a preferred vase-type configuration 36 having a relatively, substantially thicker consistency, utilizing the present method of the invention, it is found in the pouring and working in steps, 24 and 28, that the preselected amount of the water fluid 26 utilized, which is again preferrably regular tap water, was determined in accordance with the equation: $Y=0.14968x+2.62166$, or about $0.5x+2.6$; where "x" equals the preselected number of chosen units of weight of the caulk material 20, and "y" equals the number of the same units of weight, or the equivalent units of volume thereof. In these same trial-uses it was found that about 16.9% to about 7.6% of the total initial combined weight of caulk 20 and water 26, after the pouring step 24, was the weight of the water 26 utilized.

EXEMPLAR V

The present method is utilized to produce a number of reduced and half-size vase-like configurations 36, where the amount of water 26 utilized in pouring 24 and working/rubbing-in 28 is preferably in accordance with the equation: $y=0.32489x+0.23488$, or about $0.33x+0.24$; where "x" equals the preselected number of chosen units of weight of the caulk material 20 utilized, and "y" equals the amount in the same units of weight or equivalent units of volume. Preferably, the range of the amount of caulk material 20 utilized to produce this type of configuration 36, in this embodiment, is found to be from about 30.00 grams to about 60.00 grams (x=about 30.00 to about 60.00). In these uses it was found that from about 22.5% to about 35.5% of the total weight, after pouring 24, is found to be the weight of the water 26 utilized.

EXEMPLAR VI

In producing a vase-like configuration 36, having a preferred medium consistency, in accordance with the method, it was found that the amount of the water 26 to be utilized in pouring 24 and working-in 28 is preferably determined by the equation: $y=0.31394x+(-8.02228)$ or about $0.31x-8.02$; where "x" equals the selected number of units of weight of caulk 20 utilized, or equivalent volume units thereof, with x=to at least about 25.870 grams or equivalent; and "y" equal to the amount of the water 26 utilized in the same units. In the related trial-uses it was found that from about 20% to about 26% water 26 by weight, or equivalent, was utilized.

EXEMPLAR VII

The production of lighter consistency configurations, utilizing from about 30% to about 36% water 26 by weight in pouring 24, indicated in these cases that the amount of water 26 to be used, is determined by the equation: $y=-0.01010x+36.86358$, or about $0.01x+36.9$.

EXEMPLAR VIII

Additional uses producing large flower-vase like configurations 36, utilizing the present method, yielded a combination of water 26 and caulk 20 (re 24 and 28), in substantial accordance with the equation:

$y=0.09147x+8.46255$, or about $0.09x+8.46$; where "x" equals the amount of units in weight, and "y" equals the amount of water 26 by weight utilized in the same units, or equivalent thereof.

EXEMPLAR IX

The method is utilized in a preferred embodiment of the invention to produce small (smaller relatively) dimensionalized caulk FIGS. 76, where the combination of water 26 utilized and acrylic latex caulk body 70 utilized is selected, or-preferably determined, in accordance with the equation: $y=0.164112797x+0.190286510$, or about $0.16x+0.19$, where "x" equals the preselected numerical weight of the caulk material 70 utilized in selected units, and "y" equals the weight of the water fluid 26 utilized in the same units, or equivalent thereof. A preferred configuration of the FIG. 76, is in the form of a relatively small to medium flower bud or leaf.

The preferred amount of time for precuring 30 is in the range of from about 5 to about 7 hours, where, in accordance with the method, the caulk material body 70 then has the qualities of a malleable consistency as described. Additionally, during the indicated precuring 30 time period, the caulk body 70 loses an average of about 19.1% of its original starting weight while still remaining substantially malleable and shapeable, having a range of loss of original weight before precuring 30 of from about 14.3% to about 22.9%. This, together with, or separate from, the indicated precuring time of from about 5 to about 7 hours, can be an indicating or defining factor for determining the preferred amount of time for precuring 30.

EXEMPLAR X

In related trials producing and preparing smaller dimensionalized FIGS. 76, the ratio relationship found to exist between the water 26 and the caulk body 70 utilized, after pouring 74, is found to be the ratio of about one (1) part water fluid 26 by weight or equivalent, to a range of from about 1.75 parts to about 5.5 parts caulk material 70 by weight or equivalent. The percentage of water utilized in pouring is found to be between about 18.2% and about 57.2% water 26 by weight after pouring 74 (of the total of the water and the caulk material). A particularly preferred configuration 76 is produced by the method when utilizing between from about 30% to about 44% water 26 by weight.

EXEMPLAR XI

In producing a small dimensionalized FIG. 76 which is relatively very small, when the amount of caulk material 70 utilized is from about 0.7 grams to about 1.1 grams or equivalent, the amount of water 26 used in the method is equal to or less than about 0.4 grams or equivalent. In this example of the utilization of a preferred embodiment of the method of the present invention, the percentage of water fluid 26 used by weight of the water 26 and acrylic latex caulk body 70, after pouring 74, is from about 36.4% to about 57.1% water 26 by weight or equivalent.

EXEMPLAR XII-A

The method is utilized, as indicated in a preferred embodiment thereof, to produce an ornamental background on an exhibition surface at room temperature, which upon partially drying can be used to attach configurational figures of the present invention thereto; and upon further drying and/or curing can be used to sketch, draw or add other artistic embellishment upon. The combination of water 26 and caulk 90 in this embodiment example in the adding 89 and mixing 94 steps therein, is preferably determined in accordance with the equation: $y=0.601696531x+(-10.56054136)$, or about $0.60x-10.56$, where "x" equals the preselected numerical weight of the caulk material 90 in selected units, utilized, where $x>$(is greater than) 17.600 (or thereabout), and "y" equals the weight of the water fluid 26 utilized in the same weight units, or equivalent units of volume or other equivalent. In such uses as set forth, a preferred light to medium, art-utilizable, background surface 100 is produced.

EXEMPLAR XII-B

In related trials producing and preparing the use of ornamental background surfaces 100 in this embodiment of the invention, the ratio relationship existing therein between the water fluid 26 utilized and the amount of the caulk material 90 utilized in the mixing step 94, is about one (1) part by weight or equivalent water 26 to from between about 2.3 parts to about 6.4 parts of caulk material 90 by weight or equivalent. The preferred amount of time allocated for drying 99 of the background 100 is between about 30 to 45 minutes to utilize the surface for attachment of figures and configurations (where the background 100 itself assists fixed attachment thereto); and up to about at least 12 hours to preferably use the surface for adding other artistic embellishment and attachment (by means other than self-assisted attachment or fixed securement) of figures and other items, or for additional painting or coloring or design.

Together with the range of drying time indicated for different purposes as just described herein, a limiting or defining factor of a drop in the original weight of the caulk material 90 utilized, of from about 5.6% to about 27.8%, can be considered with, or apart from the indicated time factor to determine preferrable drying 99 periods.

Various simultaneous solution, graphical, topological and other mathematical relationships exist between the equations set forth herein constituting examples of the use of the method of the present invention, and the ratio relationships set forth for the described examples of preferred embodiments, as well as the caulk configurational products produced by the present method of the invention.

While the present invention has been described connection with the particular embodiments and examples thereof, it will be understood that many changes and modifications of this method and invention may be made by those skilled in the art without departing from the true spirit, concepts and scope thereof. For example, as indicated, other diversified types and kinds of materials and/or substances, etc., may be used for the water fluid 26, the membrane layer 16 (of the work surface 10), the absorbent layer 14 and the base layer 12, as well as for the types of utilizable exhibition surfaces 50 chosen; and a diverse choice and number of sizes, forms and shapes of configurations and forms (36 and 76) can be produced as well as a number of different types of consistencies of background surface; by practicing the present invention (method and device).

Accordingly, the appended claims are intended to cover all such changes and modifications as falling within the true spirit and scope of the present invention. The reader is requested to determine the scope of the invention by the appended claims and their legal equivalents, and not by the examples which have been given.

Having described my invention, I claim:

1. A method for fabricating a dimensionalized geometric configuration from a siliconized acrylic latex caulk material on a multilayered work surface, under room temperature conditions, for transfer to an exhibition surface, comprising the steps of:

adding a preselected amount of siliconized acrylic latex caulk material to a plastic coated, semi-permeable, membraned work surface within the perimeter of a contemplated, planned configuration;

pouring over said caulk material a preselected amount of aqueous fluid;

working in said fluid into said caulk material, such that a partial to substantial slurry is initially and temporarily produced by the caulk material and the fluid on said work surface;

precuring said caulk material in discernible stages, after said working in step, by draining the fluid off of said caulk material in time delayed partial amounts over a short to moderate relative range of time;

hand-shaping the caulk material during each of desired said discernible stages of precuring to form a selected, dimensionalized caulk-configuration having at least top and bottom ends;

secondarily curing the caulk configuration such that it becomes substantially nonmalleable in consistency and hardness, and such that the bottom surface of the caulk-configuration becomes removably but securely attached to the top surface of the work surface, along and within the bottom perimeter thereof;

transferring the configuration to a porous, elastic exhibition surface;

cantilevering the configuration on the elastic exhibition surface by self-adhering attachment of the configuration at one of its ends such that the configuration is both removably fixed to the exhibition surface and cantilevered, extending at least in part over without touching the exhibition surface while being removably fixed and supported at one of its ends.

2. The method of claim 1, wherein:

before the first adding step, the method additionally includes:

fabricating a multi-layered work surface having removable, juxtaposed bottom layer, middle layer and top-membrane layer portions, the top surface of said top-membrane layer being freely exposed, and utilized when in said juxtaposed position, for fabricating a caulk configuration.

3. The method of claim 2, wherein:

in said pouring step, the preselected amount of said fluid is determined in accordance with the equation:

$$y=0.32x-[8,06]8.06,$$

where:

x equals the preselected number of units in grams of weight of said caulk material, where x is a number at least greater than about 25.000 units, and y equals the weight of said fluid in grams.

4. The method of claim 2, wherein:

said fabricating step comprises:

installing a flattened bottom-layer portion having substantially hard top and bottom surfaces, onto an ultimate supporting surface;

adding on top of said bottom layer portion, a second-middle layer portion having substantially absorbent top and bottom surfaces; and additionally adding on top of said second-middle layer portion, a semi-transparent, third-top membrane layer portion, having plastic coated top and bottom surfaces;

such that each of said layer portions rest on top, and in juxtaposition to one another, with the top surface of said third-top membrane portion being the surface utilized for supporting the caulk material and said shaped caulk-configuration.

5. The method of claim 4, wherein:

after said secondary curing step, the method further comprises:

removing the top layer portion of said work surface supporting said caulk configuration, from said multilayered work surface;

cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached, to, and a part of, and within, the lower surface perimeter of the caulk-configuration, in support thereof; and transfering the caulk-configuration for positioning and fixed placement on an exhibition surface.

6. The method of claim 5, wherein:

said fabricating of said multilayered work surface further comprises the additional step of:

inserting a pattern of a desired structure or form between the second-middle layer portion and the third-top membrane portion of said multilayered work surface, whereby said pattern can be seen at least in part visually through said membrane portion for aiding in the adding of caulk material to the work surface within the perimeter of a chosen selected configuration;

and where in, after said removing of said first membrane portion, and before said transfering step:

shaping and curving the edges of the caulk-configuration downwardly towards its bottom surface, placing said caulk-configuration onto a separate second membrane layer, the top and bottom ends of said second membrane layer defining top and bottom open channels, respectively, secondarily adding to the bottom open channel a second caulk body, and tertiarily curing said caulk configuration on said second membrane layer such that said configuration is further cured and hardened, and said second caulk body is moderately to substantially cured.

7. The method of claim 2, wherein:

in said pouring step, the preselected amount of said fluid is determined in accordance with a ratio relationship, where:

about one part of said fluid by weight or equivalent thereof is used with between from about 2.8 parts to about 5.0 parts by weight or equivalent of said caulk material.

8. The method of claim 5, wherein:

in said pouring step, the preselected amount of said fluid is determined in accordance with the equation:

$y=0.198x+5.38,$ where:

x equals the preselected number of units in grams of weight of said caulk material, and y equals the units of weight in grams of the fluid utilized.

9. The method of claim 5, wherein:

in said pouring step, the preselected amount of said fluid is determined in accordance with the equation:

$y=0.15x+2.6,$ where:

x equals the preselected number of units in grams of weight of said caulk material, and y equals the number of units in grams of weight of said fluid.

10. The method of claim 5, wherein:

in said pouring step, the preselected amount of said fluid is determined in accordance with the equation:

$y=0.33x[=]\pm0.24,$ where:

x equals between from about 30.00 to about 60.00 grams of said caulk material, and y equals the amount of fluid in grams of weight.

11. The method of claim 5, wherein:

in said pouring step, the preselected amount of said fluid utilized is determined by, and equal to about the value of "y" in an equation:

$y=0.31x-8.02,$ where:

x equals the preselected number of units in grams of weight of said caulk material, where x is equal to at least about the value of a number greater than about 25.870 grams, and y equals the numerical amount of said fluid in grams of weight;

and where in:

said configuration has a medium to heavy consistency.

12. The method of claim 11, wherein:

in said pouring step, the preselected amount of fluid is from about 20% to about 26% fluid by weight after being added to said caulk material, such that the amount of fluid is determined in accordance with a ratio relationship:

where:

about one part of fluid is added with from between about 3.80 parts to about 5.00 parts caulk material, of the combined parts of said fluid and said caulk material.

13. The method of claim 5, wherein:

the flattened bottom-layer of said multilayered work surface is a flattened section of substantially resilient and hardened cardboard;

the second-middle layer portion of said work surface is a section of absorbent paper-toweling material;

the third-top membrane portion of said work surface is a section of wax paper material;

said caulk material is siliconized acrylic latex caulk;

said exhibition surface is an arts-crafts, porous canvas material; and said fluid is a moderate temperature tap water.

14. The method of claim 2, wherein:

in said pouring step, the preselected amount of said fluid is determined in accordance with the equation:

$y=0.16x+0.19,$ where:

x equals the preselected amount of units in grams of weight of caulk material, and y equals the weight in grams of said fluid, and wherein:

a product of said method is a durable dimensionalized acrylic latex caulk configuration, comprising sculpted portions for cantileverable support above but not in contact with an underlying exhibition surface when positioned at one of its ends and attached thereon.

15. The method of claim 2, wherein:

in said pouring step, the preselected amount of said fluid is determined in accordance with a ratio of about one part of fluid to a range of from about 1.75 parts to about 5.5 parts of caulk material, said fluid being tap water.

16. A method for fabricating a dimensionalized geometric configuration from an acrylic latex caulk material on a multilayered work surface, under room temperature conditions, for transfer to an exhibition surface, comprising the steps of:

fabricating a multilayered work surface having removable, juxtaposed bottom layer, middle layer and top-membrane layer portions, the top surface of said top-membrane layer being freely exposed, and utilized when in said juxtaposed position for fabricating a caulk configuration;

adding an amount of acrylic latex; caulk material to a work surface within the perimeter of a contemplated, planned configuration;

pouring over said caulk material a preselected amount of aqueous fluid;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness and such that the bottom surface of the caulk configuration becomes removably but securely attached to the top surface of the work surface, along and within the bottom perimeter thereof;

removing the top layer portion of said work surface supporting said caulk configuration, from said multilayered work surface;

cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached, to, and a part of, and within, the lower surface perimeter of the caulk-configuration, in support thereof, and transfering the configuration onto an exhibition surface.

17. The method of claim 16, wherein:

in said pouring step, the preselected amount of said fluid is determined in accordance with the equation:

$$y=0.32x-8.06,$$

where:

x equals the preselected number of units in grams of weight of said caulk material, where x is equal to a number of said units in grams at least greater than about 25, and y equals the number of units in grams of weight of said fluid.

18. The method of claim 16, wherein:

in said pouring step, the preselected amount of said fluid is determined in accordance with a ratio relationship, where:

about one part of said fluid by weight is used with between from about 2.8 parts to about 5.0 parts by weight of said caulk material.

19. A method for fabricating a dimensionalized geometric configuration from an acrylic latex caulk material on a multilayered work surface, under room temperature conditions, for transfer to an exhibition surface, comprising the steps of:

adding a preselected amount of acrylic latex caulk material to a work surface within the perimeter of a contemplated, planned configuration;

pouring over said caulk material a preselected amount of an aqueous fluid;

working in said aqueous fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness, and such that the bottom surface of the caulk configuration becomes removably but securely attached to the top surface of the work surface, along and within the bottom perimeter thereof;

before the first adding step, fabricating a multi layered work surface having removable, juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration; and after said secondary curing step, the method comprising:

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface.

20. A method for fabricating a dimensionalized geometric configuration from an acrylic latex caulk material on a multilayered work surface, under room temperature conditions, for transfer to an exhibition surface, comprising the steps of:

fabricating a multilayered work surface having removable, juxtaposed bottom layer, middle layer and top-membrane layer portions, the top surface of said top-membrane layer being freely exposed, and utilized when in said juxtaposed position for fabricating a caulk configuration, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration, said fabricating of said multilayered work surface further comprising the additional step of: inserting a pattern of a desired structure or form between the second-middle portion and the third-top membrane portion of said multilayered work surface, whereby said pattern can be seen at least in part visually through said membrane portion for aiding in the adding of caulk material to the work surface within the perimeter of a chosen selected configuration;

adding a preselected amount of acrylic latex caulk material to a work surface within the perimeter of a contemplated, planned configuration;

pouring over said caulk material a preselected amount of aqueous fluid;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness and such that the bottom surface of the caulk configuration becomes removably but securely attached to the top surface of the work surface, along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof, and wherein, after said removing of said first membrane portion, shaping and curving the edges of the caulk-configuration downwardly towards its bottom surface, placing said caulk-configuration onto a separate second membrane layer, the top and bottom ends of said second membrane layer defining top and bottom open channels, respectively, secondarily adding to the bottom open channel a second caulk body, and tertiarily curing said caulk configuration on said second membrane layer such that said configuration is further cured and hardened, and said second caulk body is moderately to substantially cured; and transfering the caulk-configuration onto an exhibition surface.

21. A method for fabricating a dimensionalized geometric configuration from an acrylic latex caulk material on a multilayered work surface, under room temperature conditions, for transfer to an exhibition surface, comprising the steps of:

fabricating a multilayered work surface having removable, juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration;

adding a preselected amount of acrylic latex caulk, material to a work surface within the perimeter of a contemplated, planned configuration;

pouring over said caulk material a preselected amount of aqueous fluid;

working in said fluid into said caulk material, such that a partial to substantial slurry is initially and temporarily produced by the caulk material and the fluid on said work surface;

precuring said caulk material, after said working in step, for selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially malleable in consistency and hardness, and such that the bottom surface of the caulk configuration becomes removably but securely attached to the top surface of the work surface, along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and;

transfering the configuration onto an exhibition surface;

and wherein:

in said pouring step, the preselected amount of said fluid is determined in accordance with the equation:

$$y=0.198x+5.38,$$

where:

x equals the preselected number of units in grams of weight of said caulk material, and y equals the units of weight in grams of the fluid utilized.

22. A method for fabricating a dimensionalized geometric configuration from an acrylic latex caulk material on a multilayered work surface, under room temperature conditions, for transfer to an exhibition surface, comprising the steps of:

fabricating a multilayered work surface having removable, juxtaposed bottom layer, middle layer and top-membrane layer portions, said fabricating step comprising:

installing a flattened bottom-surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration;

adding a preselected amount of acrylic latex caulk material to a work surface within the perimeter of a contemplated, planned configuration;

pouring over said caulk material a preselected amount of aqueous fluid, wherein:

in said pouring step, the preselected amount of said fluid is determined in accordance with the equation:

$$y=0.15x+2.6,$$

where:

x equals the preselected number of units in grams of weight of said caulk material, and y equals the number of units in grams of weight of said fluid;

working in said fluid into said caulk material, such that a partial to substantial slurry is initially and temporarily produced by the caulk material and the fluid on said work surface;

precuring said caulk material, after said working in step, for a selected period of time, such that the caulk material remains malleable, and such that the caulk material becomes partially but removably attached to the top layer of the work surface;

shaping the caulk material, after said precuring step, to form a selected, dimensionalized caulk-configurations having top and bottom ends;

secondarily curing the caulk configuration such that it becomes substantially nonmalleable in consistency and hardness, and such that the bottom surface of the caulk configuration becomes removably but securely attached to the top surface of the work surface, along and within the bottom perimeter thereof;

removing the top layer portion of said work surface supporting aid caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface.

23. A method for fabricating a dimensionalized geometric configuration from an acrylic latex caulk material on a multilayered work surface under room temperature conditions, for transfer to an exhibition surface, comprising the steps of:

fabricating a multilayered work surface having removable, juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration;

adding a preselected amount of acrylic latex caulk material to a work surface within the perimeter of a contemplated, planned configuration;

pouring over said caulk material a preselected amount of aqueous fluid, wherein:

in said pouring step, the preselected amount of said fluid is determined in accordance with the equation:

$$y=0.33x+0.24,$$

where:

x equals between from about 30.00 to about 60.00 grams, or equivalent units thereof, of said caulk material, and y equals the amount of fluid in said units;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness, and such that the bottom surface of the caulk configuration becomes removably but securely attached to the top surface of the work surface, along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface.

24. A method for fabrication dimensionalized geometric configuration from an acrylic latex caulk material on a multilayered work surface under room temperature conditions, for transfer to an exhibition surface, comprising the steps of:

fabricating a multilayered work surface having removable juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration;

adding a preselected amount of acrylic latex caulk material to the work surface within the perimeter of a contemplated, planned configuration;

pouring over said caulk material a preselected amount of aqueous fluid, wherein:

in said pouring step, the preselected amount of said fluid utilized is determined by, and equal to about the value of "y" in an equation:

$$y=0.31x-8.02,$$

where x equals the preselected number of units in grams of weight of said caulk material, where x is equal to at least about the value of a number greater than about 25.870, and y equals the numerical amount in grams of weight of said fluid;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surfaces;

shaping the caulk material, after said precuring step, to form a selected, dimensionalized caulk-configuration having top and bottom ends;

seconarily curing the caulk configuration such that it becomes substantially nonmalleable in consistency and hardness, and such that the bottom surface of the caulk configuration becomes removably but securely attached to the top surface of the work surface; along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface.

25. A method for fabricating a dimensionalized geometric configuration from an acrylic latex caulk material on a multilayered work surface under room temperature conditions, for transfer to an exhibition surface, comprising the steps of:

fabricating a multilayered work surface having removable juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in justaposition to one another, with the top surface of said third-top membrane being the surface utilized for supporting the caulk material and said shaped caulk-configuration;

adding a preselected amount of acrylic latex caulk material to a work surface within the perimeter of a contemplated, planned configuration:

pouring over said caulk material a preselected amount of aqueous fluid, wherein:

in said pouring step, the preselected amount of fluid is from about 20% to about 26% water fluid by weight after being added to said caulk material, such that the amount of said fluid is determined in accordance with a ratio relationship where about one part of said fluid is added with from between about 3.80 parts to about 5.00 parts caulk material, of the combined parts of said fluid and said caulk material;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness, and such that the bottom surface of the caulk configuration becomes removably but securely attached to the top surface of the work surface, along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion from around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface.

26. A method for fabricating a dimensionalized geometric configuration from an acrylic latex caulk material on a multilayered work surface under room temperature conditions, for transfer to an exhibition surface, comprising the steps of:

fabricating a multilayered work surface having removable juxtaposed bottom layer, middle layer and top-membrane layer portions, said fabricating step comprising:

installing a flattened bottom-layer portion having substantially hard top and bottom surfaces, onto an ultimate supporting surface, adding on top of said bottom layer portion, a second-middle layer portion having substantially absorbent top and bottom surfaces, and additionally adding on top of said second-middle layer portion, a semi-transparent, third-top membrane layer portion, having substantially plastic coated, top and bottom surfaces, such that each of said layer portions rest on top, and in juxtaposition to one another, with the top surface of said third-top membrane being the surface utilized for supporting the caulk material and said shaped caulk-configuration, wherein:

the flattened bottom-layer of said multilayered work surface is a flattened section of substantially resilient and hardened cardboard, the second-middle layer portion of said work surface is a section of absorbent paper-toweling material, the third-top membrane portion of said work surface is a section of wax paper material;

adding a preselected amount of acrylic latex caulk material to the work surface within the perimeter of a contemplated, planned configuration, said caulk material being a siliconized acrylic latex caulk;

pouring over said caulk material a preselected amount of aqueous fluid, said fluid being a moderate temperature tap water;

working in said fluid into said caulk material, such that a partial to substantial slurry is initially and temporarily produced by the caulk material and the fluid on said work surface;

precuring said caulk material, after said working in step, for a selected period of time, such that the caulk material sets up at a partial hardness whereby the caulk material remains malleable, and such that the caulk material becomes partially but removably attached to the top layer of the work surface;

shaping the caulk material, after said precuring step, to form a selected, dimensionalized caulk-configuration having top and bottom ends;

secondarily curing the caulk configuration such that it becomes substantially nonmalleable in consistency and hardness, and such that the bottom surface of the caulk configuration becomes removably but securely attached to the top surface of the work surface, along and within the bottom perimeter thereof;

removing the top layer portion of said work surface supporting said caulk configuration, from said multilayered work surface, cutting along the perimeter of said caulk-configuration, separating the membrane into a first membrane portion outside the perimeter of the caulk configuration, and a second membrane portion a part of and inside the lower surface perimeter of said caulk-configuration, then removing the first membrane portion form around and in contact with the lower surface perimeter of said caulk-configuration, while retaining the second membrane portion, now fixedly attached to, and a part of, and within, the lower surface perimeter of the caulk-configuration, in support thereof; and transfering the configuration onto an exhibition surface, said exhibition surface being an arts-crafts, porous canvas material.

27. The method of claim 1, wherein:

in said adding and said pouring steps, when the amount of caulk material added is from about 0.7 grams to about 1.1 grams, the amount of said aqueous fluid utilized in said pouring step is about 0.4 grams, said aqueous fluid being tap water.

* * * * *